United States Patent [19]

Hruby, Jr.

[11] 4,055,306

[45] Oct. 25, 1977

[54] LIQUID SPRAY NOZZLE HAVING A RANDOMLY DIRECTIONALLY UNSTABLE DISCHARGE CHARACTERISTIC

[75] Inventor: John O. Hruby, Jr., Burbank, Calif.

[73] Assignee: Rain Jet Corporation, Burbank, Calif.

[21] Appl. No.: 706,466

[22] Filed: July 19, 1976

[51] Int. Cl.[2] ..... B05B 1/08

[52] U.S. Cl. ..... 239/601; 239/102; 239/DIG. 16

[58] Field of Search ..... 239/DIG. 16,17, 101, 239/102, 589, 601

[56] References Cited

U.S. PATENT DOCUMENTS

| | | | |
|---|---|---|---|
| 3,628,726 | 12/1971 | Johnson et al. | 239/101 |
| 3,643,866 | 2/1972 | Hruby, Jr. | 239/101 |
| 3,684,176 | 8/1972 | Hruby, Jr. | 239/101 |
| 3,687,369 | 8/1972 | Johnstone | 239/102 |
| 3,892,363 | 7/1975 | Hilger | 239/101 X |
| 3,982,605 | 9/1976 | Sneckenberger | 239/589 X |

*Primary Examiner*—Robert W. Saifer
*Attorney, Agent, or Firm*—Christie, Parker & Hale

[57] ABSTRACT

A liquid discharge nozzle for producing a randomly directionally unstable liquid discharge characteristic includes a body having a chamber therein. An inlet is provided to the chamber. An outlet duct is defined from an end of the chamber to the exterior of the body. The outlet duct has a straight constant diameter first portion communicating from the chamber to a flared second portion of the outlet duct. The duct first portion has a ratio of length to diameter in the range from about 4 to about 18. The diameter of the duct second portion increases proceeding away from the chamber from an initial diameter essentially equal to that of the duct first portion. While the ultimate flare angle of the duct second portion relative to the axis of the duct first portion may exceed 6°, if the ultimate flare angle is greater than 6° then the duct first and second portions are coupled directly by a transition flare in which the ultimate flare angle is developed transitionally in at least one transition section having a flare angle in the range of about from 2° to no more than 6°. The chamber is defined in cooperation with the positions of the inlet and outlet duct relative to each other for substantially linear flow of liquid through the duct first portion during operation of the nozzle.

24 Claims, 7 Drawing Figures

LIQUID SPRAY NOZZLE HAVING A RANDOMLY DIRECTIONALLY UNSTABLE DISCHARGE CHARACTERISTIC

CROSS-REFERENCE TO RELATED APPLICATIONS

The invention described and claimed in the present application is related to the invention described and claimed in my copending application Ser. No. 706,464 filed on the same day as this application and assigned to the same assignee. My copending application Ser. No. 706,465, also filed on the same date as this application and assigned to the same assignee, describes the use of nozzles in accordance with this invention in the context of a showerhead or similar water discharge device.

BACKGROUND TO THE INVENTION

1. Field of the Invention

This invention relates to liquid spray nozzles. More particularly, it relates to nozzles in which the liquid discharge is randomly directionally unstable over a wide range of applied liquid pressures.

2. Review of the Prior Art

My prior U.S. Pat. No. 3,684,176 describes a liquid discharge nozzle which is arranged to produce a discharge which pulsates randomly in intensity and in which the principal discharge trajectory oscillates randomly within a basic conical limiting envelope defined by the nozzle structure. This then-novel discharge characteristic, as set forth in the patent, is produced when the nozzle has an elongate inner chamber, a restricted inlet to the chamber at one end thereof, and a single outlet duct from the chamber having an area much less than the mean transverse area of the chamber but greater than the inlet area and also a conically flared outlet end. In such a nozzle, the inlet to the chamber is formed through a plug-like septum at the inlet end of the chamber. Thus, according to my prior patent, the desired discharge characteristic described therein required the use of a nozzle having an inlet to and an outlet duct from the chamber, the inlet and the outlet each having an area less than cross-sectional area of the chamber with the outlet duct being of greater area than the inlet; the prior nozzle also required a conical flare on the outer end of the outlet duct.

Nozzle structures in accord with the teachings and descriptions of my prior U.S. Pat. No. 3,684,176 function to produce a randomly directionally unstable discharge characteristic only when the liquid (typically water) applied to the nozzle is at relatively high pressure of about 25 pounds per square inch gage pressure or more; these nozzles produce this discharge characteristic for all applied water pressures greater than the threshold pressure associated with the initial manifestation of the unique discharge effect.

Shortly following the filing of the patent application which resulted in U.S. Pat. No. 3,684,176, and before the issuance of the patent on that application, I undertood a research and development program in an effort to produce a nozzle structure which would produce this unique discharge characteristic when the applied water pressure was relatively low, say on the order of 5 psig or less, and which would maintain the discharge characteristic over a wide range of higher applied water pressures. This research and development program extended for approximately 5 years. I found that I could make most any nozzle structure, defined in accordance with the teachings of my prior patent, function to produce the randomly directionally unstable discharge characteristic if the nozzle structure included an inlet choke (i.e., the inlet opening to the chamber was defined through a septum at the inlet end of the chamber) and if the inlet opening had an effective water flow area less than the effective water flow area of the outlet duct from the chamber. I was unable, until making the discovery which is an aspect of the present invention, to produce a nozzle structure in accord with my prior patent which operated reliably to produce the desired discharge characteristic when operated over a wide range of applied water pressures beginning at about 5 psig or less. The problem which I encountered with nozzles structured according to the descriptions of my prior patent was one of pressure loss and inefficiency due to the effects of the restricted inlet to the chamber within the nozzle. In an attempt to reduce pressure loss through the nozzle and to improve the liquid discharging efficiency of the nozzle structure, the inlet opening of the prior nozzle was made larger than the area of the outlet duct, but I found that this structural variation caused a loss of any ability to predictably produce the desired discharge characteristic over the desired wide range of water pressures. In other words, as the inlet opening to the chamber was enlarged to be equal to or greater than the area of the outlet duct from the chamber to the exterior of the nozzle, the ability to produce a reliable operating nozzle having a reliably predictable discharge oscillation threshold pressure became a random occurrence.

I have now discovered that the randomly directionally unstable discharge characteristics of the type produced by nozzles described in my prior U.S. Pat. No. 3,684,176 can be obtained predictably in nozzle structures which have no flow-restricting plug-like septum across the interior of the nozzle body and through which the inlet is defined to the chamber from which the outlet duct communicates. In the "plugless" or "unchoked" nozzles to which this patent application is addressed, the desired randomly directionally unstable discharge characteristic is accomplished in a predictable manner over a wide range of pressures, beginning at low pressures on the order of 5 psig or less, by the proportioning and geometry of the outlet duct from the nozzle. One aspect of the present invention is the recognition that the relationships and structural features described in U.S. Pat. No. 3,684,176 are in effect, a special case, which in some respects is an optimum case, of broader relationships which can be used to produce the same result. This invention removes limitations from the technology and art pertinent to nozzles of the type described in my prior patent, and thereby advances the pertinent technology and art.

I have also discovered that nozzles of the type described in my prior patent are not readily scalable from one size to another, particularly into small size nozzles. It is believed that this difficulty in downwardly scaling of nozzles according to my prior patent is due, at least in part, to the increasing significance and effect of liquid viscosity as the size of the nozzle is reduced.

A need exists for liquid discharge nozzles for handling water, for example, which produce the desirable pulsation impact effect associated with the randomly directionally unstable discharge characteristic of nozzles according to U.S. Pat. No. 3,684,176, but which do so over a wide range of pressures beginning at relatively low pressures on the order of 5 psig or less and which are of relatively small size. Such small nozzles may be used to advantage, for example, in shower heads, in certain industrial cleaning nozzles, as well as other applications where a low liquid mass flow rate over a wide range of applied pressures is desired.

The prior art specifically considered in the preparation of this patent application includes the following U.S. Pat. Nos.: 487,628; 604,873; 1,104,965; 1,762,313; 1,940,171; 1,983,634; 2,106,427; 2,175,160; 2,295,228; 2,550,573; 2,573,982; 2,735,719; 2,978,189; 3,003,548; 3,045,932; 3,054,563; 3,178,121; 3,198,442; 3,230,924; 3,240,253; 3,263,934; 3,300,142; 3,314,612; 3,326,473; 3,337,135; 3,423,026; 3,469,642; 3,490,696; 3,628,726; 3,643,866; 3,666,183; 3,675,885; 3,684,176; 3,687,369; 3,747,859; 3,750,961; 3,756,575; 3,774,846; 3,810,583; 3,823,408; and 3,884,417.

For an understanding of this invention in the context of the prior art, including that reflected by the above-listed patents, it is important to bear in mind the distinction between liquids, on the one hand, and gases, on the other hand, as opposed to the overall generic descriptive term "fluid" which is sufficiently broad to apply to both liquids and gases. This invention is concerned with liquid discharge nozzles; it is not concerned with nozzles or other structures for discharging or dispensing gases or mixtures of gases and liquids. In the context of liquid discharge nozzles, this invention is concerned with the production of a particular discharge characteristic in which, for a given condition of applied liquid flow rate and pressure, the quantity of liquid discharged does not vary from time to time, but which manifests a randomly directional unstable discharge pattern. That is, this invention is concerned particularly with the production of a liquid discharge nozzle in which the instantaneous trajectory of the principal quantity of liquid discharged from the nozzle varies randomly in angular orientation relative to the axis of the outlet duct of the nozzles, and in which the instantaneous line of principal discharge is always within an encompassing envelope of generally conical configuration defined by the nozzle structure itself. In other words, in a nozzle of the type to which this invention is specifically addressed, the discharge from the nozzle is a liquid (typically water) and, beginning at a relatively low applied pressure of say 5 pounds psig or less through a wide range of pressures, is so defined that, at any given instant, the direction of movement of the principal portion of the liquid discharged from the nozzle is randomly indeterminate but lies along a line within an enveloping cone. In nozzles of this type, there is generally at any given instant, some discharge along all potential discharge lines within the enveloping cone, the principal portion of the discharge being predominantly along one line whose attitude or relationship angularly to the axis of the outlet duct varies at a characteristic frequency which is defined principally by the geometry and proportioning of the outlet duct from the nozzle rather than by the applied liquid pressure.

SUMMARY OF THE INVENTION

Generally speaking, this invention provides a liquid discharge nozzle for producing a randomly directionally unstable discharge of the type specifically identified above. The nozzle includes a body which defines therein a chamber having a liquid inlet to the chamber and a liquid outlet duct from the chamber to the exterior of the body. The liquid flow area of the inlet to the chamber is at least as great as, and can be greater than, the minimum liquid flow area of the outlet duct. The chamber is defined cooperatively with the inlet and with the outlet duct for substantially linear flow of liquid through the outlet duct during operation of the nozzle. The outlet duct has a straight throat portion of constant diameter which communicates from the chamber to a flared second portion of the duct. The duct throat portion has a ratio of length to diameter in the range from about 4 to about 18. The diameter of the duct second portion increases, proceeding along the duct from the chamber, from a diameter equal to that of the duct throat portion. The angle of flare of the duct second portion, relative to the axis of the duct throat portion at the intersection of the duct throat and second portions, is at least 2° and is no greater than 6°. Nozzles of this nature are referred to herein as Type I nozzles.

Another related nozzle is similar to that characterized in the preceding paragraph except that in the related nozzle the duct throat and second portions are coupled by a flared transition section in which the angle of flare of the duct is not greater than about 6°, and the flare angle of the duct second portion at its end remote from the duct throat portion is greater than 6°. The diameter of the inlet end of the duct transition section is equal to the diameter of the duct throat portion. Nozzles of this nature are referred to herein as Type II nozzles.

DESCRIPTION OF THE DRAWINGS

The above-mentioned and other features of this invention are more clearly set forth in the following detailed description of presently preferred embodiments of this invention, which description is presented with reference to the accompanying drawings wherein.

DESCRIPTION OF THE ILLUSTRATED EMBODIMENTS

Figure 1:
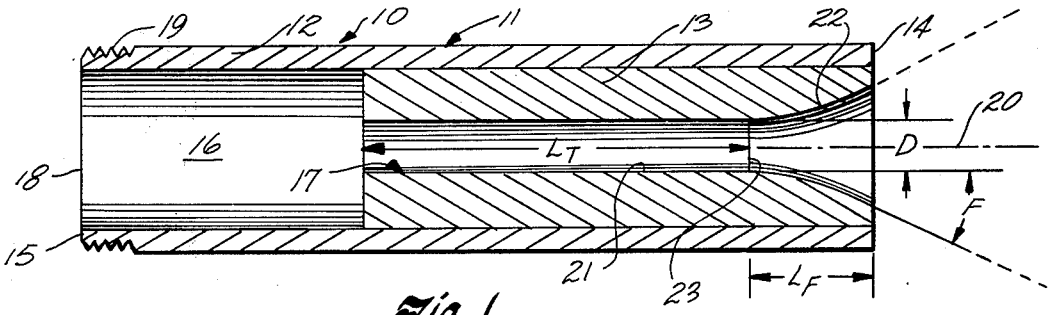
FIG. 1 is a cross-sectional elevation view of a presently preferred liquid discharge nozzle according to this invention.

A liquid discharge nozzle 10 of the impact-effect type, having a randomly directionally unstable discharge characteristic, is shown in FIG. 1. Nozzle 10, like the other nozzles shown and described, is of the impact effect type due to its randomly directionally unstable discharge effect. That is, the random oscillation in the direction of the principal discharge of the nozzle in use has the same effect, on a surface to which the discharge is directed, as if the rate of liquid discharge of the nozzle were varied or pulsed. In nozzles according to my prior U.S. Pat. No. 3,684,176, the rate of liquid discharge in fact pulsates under normal operating conditions.

Nozzle 10 has a body 11 composed principally of an elongate tube 12 and a plug 13 engaged with the interior of the tube at an outlet end 14 of the nozzle. The cooperation of the plug with the interior of the tube is sufficiently intimate that liquid introduced into an inlet end 15 of the nozzle to a chamber 16 can emerge from the nozzle only through an outlet duct 17 formed through the plug to communicate from the chamber to the exterior of the nozzle. The inlet end of tube 12 is completely open to provide an inlet opening 18 to chamber 16 which is equal in area to the cross-sectional area of the tube fare. The tube is adapted at its inlet end 15, as by external threads 19, to be connected to a suitable source of pressurized liquid which is to be discharged from nozzle 10 via outlet duct 17. In this regard the structure of nozzle 10 is similar to the structure of the other nozzles described below herein in that, as compared to the nozzle structure described in my prior U.S. Pat. No. 3,684,176, there is no plug or partition member across the interior of the tube in spaced relation to plug 13 and through which a restricted inlet opening to chamber 16 is provided. Thus, nozzles according to the present invention are "plugless" or "unchoked" nozzles as compared to the nozzles described in my prior patent.

Outlet duct 17 of nozzle 10 is coaxially aligned with liquid inlet opening 18. Coaxial alignment of the nozzle outlet duct with the nozzle liquid inlet opening is a preferred relationship in nozzles according to this invention.

Also, it is preferred that the liquid inlet to the nozzle chamber be located at the end of the chamber opposite from the opening of the liquid outlet duct to the chamber. In this manner, liquid introduced into the chamber during operation of the nozzle flows essentially linearly into the chamber and from the chamber through the outlet duct. If the outlet duct and the liquid inlet opening to the chamber are either not coaxially aligned or not located at opposite ends of the chamber, then suitable flow guiding and straightening baffles may be provided in the chamber to assure that water flowing through the outlet duct flows essentially linearly through the duct rather than in a spiral manner about the axis 20 of the duct. Spiral flow of water or other liquid through the outlet duct of a nozzle according to this invention is to be avoided in order that the desired randomly directionally unstable discharge characteristic may be achieved predictably and reliably.

It is noted at this point that, in nozzles according to this invention, according to my present understanding of these nozzles, that the flow characteristic of liquid flowing through the outlet duct can be laminar or turbulent, and no special treatments are given to the structure of the nozzle to cause the liquid flow characteristic through the outlet duct to be either laminar or turbulent. The only flow characteristic which is undesirable and which is to be avoided by appropriate cooperative structuring of the nozzle, especially in the chamber and in the context of the relative positioning of the inlet to the chamber and the opening of the outlet duct from the chamber, is a flow characteristic in which liquid flowing through the outlet duct spirals angularly about the duct axis.

Outlet duct 17 of nozzle 10 has a straight constant diameter first portion 21 which communicates directly to chamber 16, and a flared second portion 22 which opens directly to the exterior of the nozzle. The duct first portion is sometimes referred to herein as the throat.

In nozzle 10, as in all nozzles according to this invention, the ratio of the nozzle throat length $L_T$ to the nozzle throat diameter D is in the range from about 4 to about 18. I have found that where the ratio of throat length to throat diameter is in this range and the flared duct second portion 22 is configured in the manner described below, the desired randomly directionally unstable discharge characteristic, which produces a desirable impact effect, is repeatedly and predictably obtained over a wide range of applied liquid pressures beginning at pressures as low as 2½ lbs., as in the instance of the exemplary ⅛ inch nominal diameter nozzle described below, without reliance upon a restricted inlet opening to chamber 16 as is required in nozzles constructed in accord with the teachings of my prior U.S. Pat. No. 3,684,176. If size limitations or other considerations call for the use of a nozzle structure having a throat length to diameter ratio ($L_T$/D) less than 4, but still producing the randomly directionally unstable discharge effect, then nozzle arrangements of the type shown in my copending application Ser. No. 704,464 may be used to advantage.

Figure 2:
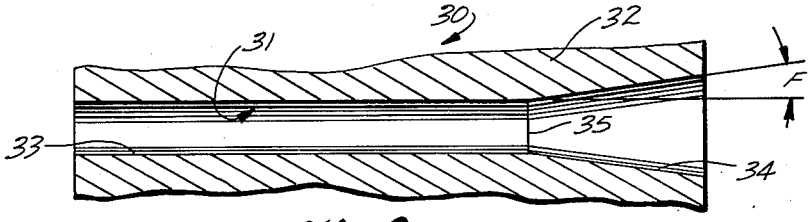
FIG. 2 is a fragmentary enlarged cross-sectional elevation view of the outlet duct of another liquid discharge nozzle.

Second portion 22 of outlet duct 17 in nozzle 10 is non-linearly flared from a minor diameter at the inlet end of the duct second portion which is equal to the diameter D of the duct throat. Proceeding along the outlet duct axis 20 away from the outlet end of the duct throat, the diameter of the duct increases in a non-linear manner to a maximum at the outlet end 14 of the nozzle where the angle of flare of the duct second portion relative to the outlet duct axis 20 is represented in FIG. 1 as angle F, the ultimate flare angle. If angle F as defined by the nozzle outlet duct is equal to or less than six degrees, then the flare angle F may be defined linearly as shown in FIG. 2 and may extend directly to the outlet end 23 of the nozzle throat where the duct diameter is equal to throat diameter D, and in such instance the surfaces of the duct section portion 22 may intersect the walls of the nozzle throat in a distinct angle, i.e., in a discontinuous manner as opposed to a smoothly faired or continuous manner. On the other hand, as shown in FIGS. 1, 4, 5, 6, and 7, if ultimate flare angle F is greater than 6°, then the duct second portion is coupled to the duct constant diameter throat portion 21 by a flared transition section (as at 25 in FIG. 3) in which the angle of flare of the duct is equal to or less than 6°. The transition section may connect at its opposite ends to the duct throat and to the duct second portion in either a continuous or discontinuous manner; the flare angle of the transition is greater than about ½° if the transition is linearly flared as opposed to arcuately flared. (It should be understood clearly that the various angles F shown in the drawings are exaggerated for the purposes of clarity of illustration.)

Figure 3:
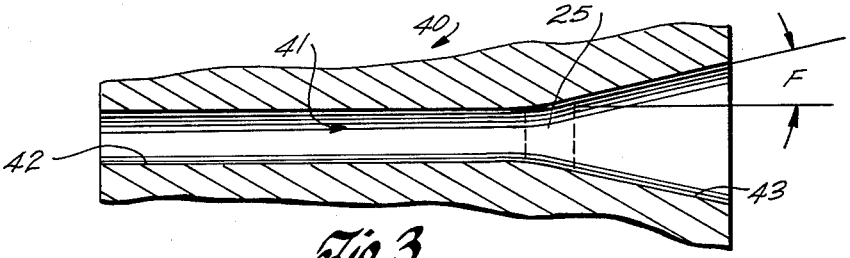
FIG. 3 is a fragmentary view, similar to FIG. 2, showing the outlet duct of still another nozzle.
Figure 4:
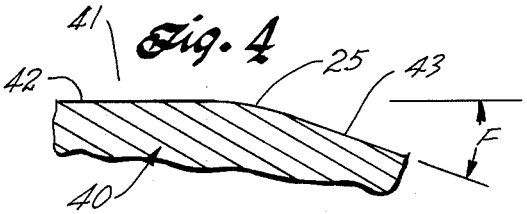
FIG. 4 is a further enlarged fragmentary view of a portion of the structure shown in FIG. 3.

A significant aspect of this invention is the recognition that the desired randomly directionally unstable discharge effect may be produced in nozzles of the general type shown in the drawings where the flare angle F is either (a) in the range of from about 2° to 6°, in which case the flare geometry can be but is not required to be linear, i.e., conical and coupled direct to the outlet end of the nozzle throat 21 so that the minimum diameter of the outlet duct in the flared portion is equal to the outlet duct throat diameter, or (b) may be greater than 6° if the flared duct second portion is coupled to the duct constant diameter throat portion by a flared transition section in which the transition flare, if of a linear nature, is in the range of from ½° to 6°, or if of a non-linear or arcuate nature, is smoothly blended into the constant diameter duct throat portion as shown in FIGS. 1, 3, and 4. This recognition of the significance of the 6° flare angle, and of its relation to the outlet duct throat, in the production of a repeatable and reliable randomly directionally unstable discharge characteristic is a basic aspect of this invention which is common to both nozzles of the plugless variety, to which the present application is directed, and to nozzles of the capped variety which are described in copending application Ser. No. 706,464 and which may have a throat length to diameter ratio less than 4.

In the presently preferred nozzle 10 which is shown in FIG. 1, ultimate flare angle F has a value of 10° and the diameter of the outlet duct increases in a non-linear manner along the entire length of the duct second portion 22 proceeding away from the outlet end 23 of duct throat portion 21. More specifically, in nozzle 10, the curvature of the outlet duct second portion, when viewed in longitudinal cross-section as in FIG. 1, is defined as a portion of a circular arc which is tangent to the duct throat at the outlet end 23 of the duct throat.

Also, in nozzle 10, as in other nozzles according to this invention, viewing this invention in its broad sense as described both herein and in copending application Ser. No. 706,464, the length $L_F$ of the duct second portion 22 along duct axis 20 is equal to or greater than about 2 times the duct throat diameter D when the flare of the duct second portion is non-linear. If a transition section is provided in the nozzle in the instance where flare angle F is greater than 6°, then the relationship $L_F$ equal to or greater than about 2D is evaluated in terms of the cumulative length of the transition section and the duct second portion.

A presently preferred embodiment of nozzle 10, itself the presently preferred nozzle according to this invention among the several nozzles shown in the accompanying drawings, includes a plug 13 which is molded of ABS resin. The plug has an overall length of 2.000 inches and defines an outlet duct in which the duct second portion has a length $L_F$ of about 0.744 inch, the remaining length of the outlet duct being the throat which has a diameter D of 0.125 inch. The ultimate flare angle F is 10° at the discharge end of the outlet duct, and the curvature of the flare along the duct second portion is that of a circle having a radius of 3.000 inches. In another embodiment of nozzle 10, the overall length of the outlet duct plug is 2 inches, the throat diameter D is 0.170 inch, the flare length $L_F$ is 0.744 inch and the radius of curvature of the flare arc is 3.000 inches; a 0.170 inch diameter throat was selected because this nozzle was designed for use in a shower head (see copending application Ser. No. 706,465 and it was desired to achieve a discharge rate of 3 gallons per minute at 20 psig. applied water pressure.

Another nozzle 30 (see FIG. 2) has an outlet duct 31 defined in a plug or other suitable member 32. The outlet duct has a first straight, constant diameter throat portion 33 having a ratio of length to diameter in the range of about 4 to about 18 as described above. Duct 31 has a linearly flared second portion 34 in which the flare angle F, measured as described above, is no greater than 6° but not less than 2°. The duct flare and throat portions connect at a discontinuity 35 at the outlet end of the duct throat at which the diameters of the flared second portion and the duct throat are equal.

A third nozzle 40 (see FIG. 3 and 4) has an outlet duct 41 defined in a plug or other similar member to have a first straight throat portion 42, a linearly flared second portion 43 opening to the exterior of the nozzle, and a transition section 25 between the throat and second portions of the duct. The throat has a length to diameter ratio in the range set forth above. The flare angle F of the linearly flared duct second portion is greater than 6° and may conveniently be in the range of from 10° to about 30° although any flare angle greater than 6° found appropriate for the intended use of the nozzle may be used, subject to the guidelines set forth below concerning the relation between high flare angles and generation of the randomly directionally unstable discharge effect. Because flare angle F of nozzle 40 is greater than 6°, transition section 25 is provided directly between the duct throat and second portions. In transition section 25, the duct diameter is increased non-linearly from the throat diameter in such a way that, at its outlet end, the transition section becomes smoothly continuous with the inlet end of the duct second portion 43 as more clearly shown in FIG. 4. Thus, the transition section 25 smoothly develops the flare of outlet duct 41 from at flare of 0° at the outlet end of the throat 42 to the flare angle of the linearly flared duct second portion 43.

Figure 5:
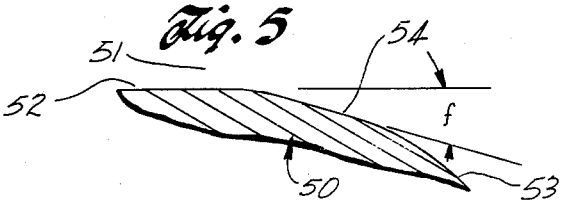
FIG. 5 is a fragmentary elevation view of the outlet duct of still another nozzle according to this invention.

FIG. 5 shows another nozzle 50 in which the outlet duct 51 has a straight throat portion 52, an arcuately curving flared second portion 53, and a linearly flared transition section 54 between the throat and second portions. The ultimate flare angle of the second portion of the duct is greater than 6°. Where, as in nozzle 50, the transition section is linearly flared, the transition flare angle *f* is in the range of ½° to 6°.

FIG. 5, especially when compared to FIG. 4, shows that a linear transition section having a flare angle *f* equal to or less than 6° can be used, if desired, with an arcuately curving duct second portion. FIG. 5 also shows that, while the diameter of the duct at the opposite ends of the transition section is equal to that of the outlet end of the throat and to the inlet end of the second section, respectively, the transition section need not merge smoothly into the inlet end of the duct second section.

Figure 6:
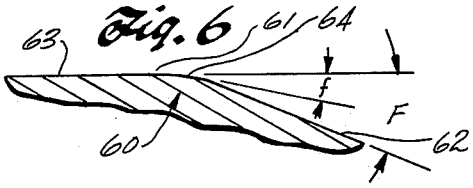
FIG. 6 is an enlarged fragmentary cross section view showing a portion of an outlet duct of still another nozzle.

FIG. 6 shows another nozzle 60 in which the outlet duct 61 has a linearly flared second portion 62 connected to the constant diameter throat 63 by a short linear transition section 64, the flare angle F of the second portion of the duct being greater than 6°. FIG. 6 particularly shows that the length of the transition section along the outlet duct can be very short, even on the order of a few hundredths of an inch. In the course of the research and development program mentioned above, I had built a series of identical nozzles having linearly flared duct second portions with a flare angle of about 10°. In these test nozzles, no transition section was provided between the nozzle throat and the flare, so that the inlet end of the flare and the outlet end of the throat were coincident and of equal diameter. These test nozzles were machined in plugs of vinyl chloride, the plugs being insertable at will into a common tube to define the complete nozzle. In testing these identical outlet duct plugs, I found that sometimes the desired randomly directionally unstable discharge characteristic could be produced at different threshold water pressures depending on the particular plug, and in other cases no discharge characteristic could be obtained at any level of applied water pressure. I found that by lightly reaming the intersection of the outlet duct throat and flare portions of all the test plugs, using a taper pin reamer manually held and applying the lightest touch possible for the shortest interval possible, all of the outlet duct plugs were made uniform in their ability to produce the desired discharge characteristic at low threshold pressure of about 5 psig and to maintain that characteristic as applied water pressure was increased to 40 psig or more. This experience shows that the transition section in a nozzle according to this invention can be very short, as illustrated in FIG. 6. The taper pin reamer which was used had a taper angle, measured according to the convention established above, of 35 minutes, 49 seconds, i.e., only slightly more than ½°.

Figure 7:
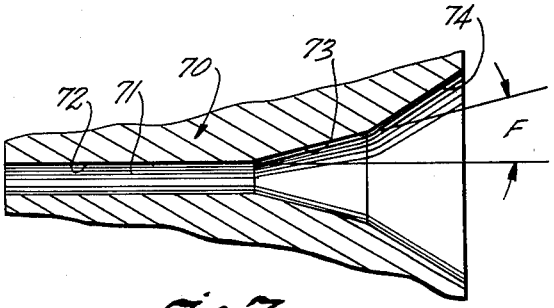
FIG. 7 is an enlarged fragmentary cross section view showing a portion of the outlet duct configuration of yet another nozzle.

FIG. 7 shows a nozzle 70 in which the liquid outlet duct 71 has a throat 72 in accord with the foregoing description, a flared second portion 73 having a flare angle F, and a third flared portion 74 which has its inlet diameter equal to the outlet diameter of the second portion. The flare angle of the duct third portion is greater than flare angle F. Flare angle F can be equal to, less than, or greater than 6°; in the latter instance, a transition section is provided between the throat and the duct second portion as described above.

From the foregoing description, it is seen that 6° is an important flare angle value in achieving the desired randomly directionally unstable characteristic in liquid discharged from the nozzle over a range of applied liquid pressure. If the ultimate flare angle is not greater than 6°, it should not be less than 2° if the flare is defined linearly; but where the flare is defined arcuately, the flare angle may be defined gradually from the throat angle of 0°. If the ultimate flare angle is greater than 6°, a transition is provided at the outlet end of the throat and the flare angle in the transition can be in the range of from about ½° to 6°. The transition need not merge smoothly either with the throat at its inlet end or with the flare at its outlet end. If the transition is linear, its flare angle is to be at least about ½°, but if it is arcuate its flare may be developed gradually from the throat angle. Where the ultimate flare angle is greater than 6°, it may be developed gradually in an arcuate manner from the throat flare angle of 0°, in which case the initial portions of the flare function as and are considered as a transition.

In all of the nozzles described above and shown in the accompanying drawing, the nozzle outlet duct flares progressively outwardly from the duct axis proceeding in the direction of liquid flow away from the outlet end of the nozzle throat. The flare configuration is either linear or arcuate. If the flare is arcuate, the curvature of the flare is convex toward the duct axis; this is a preferred situation in nozzles according to this invention at least along such a length of the outlet duct immediately downstream from the nozzle throat which is at least twice the throat diameter. However, if the flare is linear, the flare length may be less than two times the throat diameter. I have found that so long as the duct is defined, as described above, to produce the desired discharge effect, further or different geometrical treatment of the outlet duct downstream of the flared portion does not destroy the desired discharge effect. For example, the outlet duct can be of constant diameter downstream of the flared portion of the duct if desired, as for the purpose of focusing the discharged liquid stream; I prefer to accomplish whatever focusing is desired by regulating the ultimate flare angle of the duct flared portion.

Also, in the nozzles described above, the nozzle outlet ducts open to the atmosphere and the liquid discharged from the nozzle outlet ducts does not encounter any other structure of the nozzle itself. As shown in copending application Ser. No. 706,465, the randomly directionally unstable liquid discharge from the nozzle may be passed through energy modifying screens or the like for purposes other than the purposes to which this invention is addressed.

It has been found that, in nozzles according to this invention, variation of the throat length-to-diameter ratio within the range of from about 4 to about 18 affects the threshold applied liquid pressure at which the desired discharge characteristic is first produced and, to a lesser extent, the extent of the range of higher pressures at which the nozzle can be operated with no change in the discharge characteristic. In general, the higher the value of $L_T/D$ in this range, the higher the threshold liquid pressure; I prefer a value of $L_T/D$ in the range of from about 7 to about 12. If the value of $L_T/D$ is appreciably more than about 18, the nozzle outlet duct functions as a simple pipe and the desired discharge effect is not obtained for any outlet flare geometry or proportioning.

Also, it has been found that viscosity of the liquid flowing through the outlet duct of the present nozzles has an effect on the threshold pressure at which the desired discharge characteristic is first achieved in any given nozzle. Properties such as the viscosity and wettability of the liquid and the rate of flow of liquid through the nozzle are also believed to have an effect on either the maximum amount by which the outlet duct flare can be increased outwardly in a discontinuous manner downstream of any transition section which may be provided, or on the radius of curvature of an arcuately curved flare, and still cause the flare to be effective in defining the envelope for the discharge trajectories associated with the directionally unstable discharge characteristic. That is, it appears that the flare angle of the outlet duct, downstream of the outlet end of the duct throat, should not be increased arcuately at a rate greater than that corresponding to the ability of the discharge liquid to follow or "adhere" to the flare, which ability appears to be related to the velocity of liquid flow through the nozzle outlet duct. The ability of the liquid to respond to increasing steps of linear flare at varying flowrates also directs attention to these liquid properties and suggests that for any flowrate of a given liquid a relation exists between the incremental flare angle and the length of the linear flare increment. For example, a nozzle was built having a throat diameter of 0.172 inch and linear flares of 5°, 30°, and 45° in sequence in which the incremental flare lengths were 0.325 inch, 0.300 inch, and 0.420 inch, respectively, and in which the intersections of the linear flare increments with each other and with the throat were polished or smoothed locally; it was found that the discharge oscillation envelope was defined by the 45° flare when the water pressure applied to the nozzle was under 10 psig, and that the discharge envelope was defined by the 30° flare where the applied water pressure exceeded 10 psig, even up to applied water pressures of 30 psig. It thus appears that the viscosity, wettability and velocity of the liquids are the principal determinants of the ability of the liquid to follow, at least temporarily, along the flare; it is noted that the preferred nozzle 10 described above has been developed for use in a shower head for handling water at the temperature usually encountered in such usages.

The principal effect of variation of the flare angle and the flared length of the outlet duct in the present nozzles is to alter the "frequency" at which the principal liquid discharge trajectory varies within the envelope defined by the configuration of the flared portion of the outlet duct. The discharge liquid tends to follow first principally along one side of the flare for a time, then to shift to an axial discharge for a time, and then to shift to follow along another side of the flare for a time, and so forth, all in a random manner as to direction. However, over an extended period of several such shifts, the nozzles will be found to have a characteristic frequency at which these shifts occur. This characteristic frequency is not precisely defined, but is only subjectively observable. As this directionally shifting discharge from the nozzle strikes some object to which the nozzle is directed, such as a person in the case of the use of the present nozzle in a shower head, a pulsating or impacting effect suggestive of a massage is experienced.

An entirely arcuately curved flare configuration is presently preferred in the flared portion of a nozzle according to this invention; nozzle 10 is such a nozzle.

In a nozzle according to this invention, steps or shoulders should be avoided in those portions of the outlet duct flared portion which are relied upon to produce the directionally unstable discharge characteristic. Steps or shoulders facing either toward or away from the outlet end of the duct throat can be provided, either in subsequent portions of the duct geometry or in additional structure of the nozzle separate from the structure defining the outlet duct, for whatever purpose may be desired.

The term "conical" has been used above to describe the nature of the flared portion of the outlet ducts in the nozzles referred to. An arcuately flared duct is not truly conical in form, as a cone has straight sides when viewed in elevation. The term "conical" is thus seen to have been used herein to refer to a duct flare which, in all planes normal to the duct axis, has a circular cross-sectional configuration. It will be appreciated, however, that the principles of this invention can be used, without sacrifice of the randomly directionally unstable discharge characteristic, in a nozzle in which the outlet duct flare has an elliptical or other smoothly curved cross-sectional shape in all planes normal to the duct axis; such an elliptically conical flare configuration could be used where the discharge envelope is to be higher than it is wide. Thus, as used herein, including in the following claims, the term "conical" is to be interpreted broadly rather than according to its most precise geometric definition.

Workers skilled in the art to which this invention pertains will recognize that, in light of the foregoing, variations or alterations may be made in the nozzles shown without departing from the scope of this invention. The nozzle arrangements shown and described have been presented by way of example and for the purposes of illustration and do not exhaust all of the forms which the present nozzles may take. Therefore, the foregoing descriptions and examples, rather than being considered as limiting the scope of this invention, should be regarded as showing that this invention is not limited in scope to the precise wording of the following claims. What is claimed is:

1. A nozzle for producing a randomly directionally unstable liquid discharge comprising a body defining therein a chamber having a liquid inlet thereto and a liquid outlet duct from the chamber to the exterior of the body, the liquid flow area of the inlet to the chamber being at least as great as the minimum liquid flow area of the outlet duct, the chamber being defined cooperatively with the inlet and the outlet duct for substantially linear flow of liquid through the outlet duct during operation of the nozzle, the outlet duct having a straight throat portion of constant diameter communicating from the chamber to a flared second portion of the duct, the duct throat portion having a ratio of length to diameter in the range of from about 4 to about 18, the diameter of the duct second portion increasing proceeding along the duct from the chamber from a diameter equal to that of the duct throat portion, the angle of flare of the duct second portion relative to the axis of the throat at the intersection of the duct throat and second portions being at least 2° and no greater than 6°.

2. A liquid discharge nozzle according to claim 1 wherein the diameter of the duct second portion increases linearly proceeding along the duct axis from the outlet end of the duct throat portion.

3. A liquid discharge nozzle according to claim 1 wherein the diameter of the duct second portion increases non-linearly proceeding along the duct axis from the outlet end of the duct throat portion.

4. A liquid discharge nozzle according to claim 1 wherein the nozzle includes a flared outlet duct third portion coupled to the duct throat portion by the duct second portion, the diameter of the duct increasing proceeding along the duct axis from the duct second portion, the angle of flare of the duct third portion at the end thereof remote from the duct second portion being greater than 6°.

5. A liquid discharge nozzle according to claim 4 wherein the diameter of the duct along the third portion thereof increases linearly proceeding away from the duct second portion.

6. A liquid discharge nozzle according to claim 5 wherein the diameter of the duct second portion increases linearly proceeding along the duct axis from the outlet end of the duct throat portion.

7. A liquid discharge nozzle according to claim 5 wherein the diameter of the duct second portion increases non-linearly proceeding along the duct axis from the outlet end of the duct throat portion.

8. A liquid discharge nozzle according to claim 4 wherein the diameter of the duct along the third portion thereof increases non-linearly proceeding away from the duct second portion.

9. A liquid discharge nozzle according to claim 8 wherein the diameter of the duct second portion increases linearly proceeding along the duct axis from the outlet end of the duct first portion.

10. A liquid discharge nozzle according to claim 8 wherein the diameter of the duct second portion increases non-linearly proceeding along the duct axis from the outlet end of the duct throat portion.

11. A liquid discharge nozzle according to claim 10 wherein the diameter of the outlet duct along the second and third portions thereof increases smoothly and without discontinuity.

12. A liquid discharge nozzle according to claim 4 wherein the cumulative length along the outlet duct axis of the duct second and third portions is at least about two times the diameter of the duct throat portion.

13. A liquid discharge nozzle according to claim 1 wherein the length of the duct second portion along the duct axis is at least about two times the diameter of the duct throat portion.

14. A liquid discharge nozzle according to claim 1 wherein the outlet duct between the second portion thereof and the exterior of the body is flared at an angle at least as great as the duct second portion.

15. A liquid discharge nozzle according to claim 1 wherein the inlet to the chamber and the outlet duct from the chamber are defined by the body at opposite ends of the chamber.

16. A liquid discharge nozzle according to claim 15 wherein the inlet and the outlet duct are coaxially aligned.

17. A nozzle for producing a randomly directionally unstable liquid discharge comprising a body defining therein a chamber having a liquid inlet thereto and a liquid outlet duct from the chamber to the exterior of the body, the liquid flow area of the inlet to the chamber being at least as great as the minimum liquid flow area of the outlet duct, the chamber being defined cooperatively with the inlet and the outlet duct for substantially linear flow of liquid through the outlet duct during operation of the nozzle, the outlet duct having a straight throat portion of constant diameter communicating from the chamber to a flared second portion of the duct, the duct throat portion having a ratio of length to diameter in the range of from about 4 to about 18, the angle of flare of the duct second portion relative to the axis of the duct throat portion at the end of the duct second portion remote from the duct throat portion being greater than 6°, the duct throat and second portions being coupled by a flared transition section in which the angle of flare of the duct is not greater than 6°, the diameter of the inlet end of the duct transition section and the outlet end of the duct throat portion being equal.

18. A liquid discharge nozzle according to claim 17 wherein the diameter of the duct second portion increases linearly proceeding along the duct axis from the outlet end of the duct throat portion.

19. A liquid discharge nozzle according to claim 17 wherein the diameter of the duct second portion increases non-linearly proceeding along the duct axis from the outlet end of the duct throat portion.

20. A liquid discharge nozzle according to claim 19 wherein the diameter of the outlet duct along the transition and second portions thereof increases smoothly and without discontinuity.

21. A liquid discharge nozzle according to claim 17 wherein the cumulative length along the outlet duct axis of the transition section and the duct second portion is at least about two times the diameter of the duct throat portion.

22. A liquid discharge nozzle according to claim 17 wherein the outlet duct between the second portion thereof and the exterior of the body is flared at an angle at least as great as the duct second portion.

23. A liquid discharge nozzle according to claim 17 wherein the inlet to the chamber and the outlet duct from the chamber are defined by the body at opposite ends of the chamber.

24. A liquid discharge nozzle according to claim 23 wherein the inlet and the outlet duct are coaxially aligned.

* * * * *

UNITED STATES PATENT AND TRADEMARK OFFICE

CERTIFICATE OF CORRECTION

PATENT NO. : 4,055,306

DATED : October 25, 1977

INVENTOR(S) : John O. Hruby, Jr.

It is certified that error appears in the above-identified patent and that said Letters Patent are hereby corrected as shown below:

Column 1, lines 59 and 60, for "undertood" read --undertook--. Column 2, line 58, for "downwardly" read --downward--. Column 3, line 14, for "3,675,885" read --3,675,855--; line 32, for "directional" read --directionally--; line 38, for "nozzles" read --nozzle--. Column 5, line 10, for "fare" read --bore--. Column 6, line 7, for "repeatedly" read --repeatably--; line 19, for "704,464" read --706,464--; line 36, for "section" read --second--; line 63, italicize "if". Column 8, line 29, after "of" read --from--; line 62, after "no" read --such--.

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*